United States Patent [19]

Beckman et al.

[11] 4,192,471

[45] Mar. 11, 1980

[54] CRUSHING APPARATUS

[75] Inventors: Klaus Beckman; Richard Redemann, both of Lünen, Fed. Rep. of Germany

[73] Assignee: Gewerkschaft Eisenhutte Westfalia, Fed. Rep. of Germany

[21] Appl. No.: 948,953

[22] Filed: Oct. 5, 1978

[30] Foreign Application Priority Data

Nov. 4, 1977 [DE] Fed. Rep. of Germany ..... 2749313

[51] Int. Cl.[2] ..... B02C 4/02; B02C 4/32; B02C 4/42

[52] U.S. Cl. ..... 241/185 R; 241/227; 241/231; 241/232; 241/234; 241/242; 72/249; 100/172

[58] Field of Search ..... 241/185 A, 185 R, 186 R, 241/73, 220, 221, 227, 230, 231, 232, 234, 239, 240, 241, 242; 72/249; 60/330, 364; 100/172

[56] References Cited

U.S. PATENT DOCUMENTS

| | | | |
|---|---|---|---|
| 3,006,224 | 10/1961 | Celovsky | 72/249 X |
| 3,056,567 | 10/1962 | Smith et al. | 60/364 X |
| 3,964,719 | 6/1976 | Holly et al. | 241/232 X |

FOREIGN PATENT DOCUMENTS

| | | | |
|---|---|---|---|
| 2704243 | 8/1978 | Fed. Rep. of Germany | 241/232 |

*Primary Examiner*—Richard B. Lazarus
*Attorney, Agent, or Firm*—Charles E. Pfund

[57] ABSTRACT

Crushing apparatus employs a pair of rotatable crusher drums mounted to rotate about vertical axes to crush material such as mineral ore, fed through a gap between the drums by means such as scraper-chain conveyor. The drums are mounted on pivoting rocker arms which are adjustable to vary the crushing gap. The drums are hollow and are driven in opposite directions by hydraulic drive motors located inside the drums. Conveniently, the hydraulic motors have rotors connected to radial flanges inside the drums and stators fixed to the rocker arms.

8 Claims, 3 Drawing Figures

CRUSHING APPARATUS

BACKGROUND TO THE INVENTION

The present invention relates to crushing apparatus and particularly to crushing apparatus intended for use in underground mine workings in crushing or breaking-up mineral ores.

it is known to use crushing apparatus to break-up coal or mineral ore moving along a conveyor. Such apparatus employs rotatable crushing means in the form of a pair of upstanding crusher rollers or drums rotating in opposite directions to crush the ore fed between the drums. German patent specification No. 1104 797 describes a crushing apparatus of this known type. In the known crushing apparatus, the drums are driven by drive means supported on a main frame of the apparatus, and above the drums.

Usually, each drum would have its own drive motor and transmission system. As a result of this constructional layout, the height of the apparatus is quite considerable and this is disadvantageous in the cramped conditions often encountered in underground mine workings. Furthermore, the drive means for the drums is exposed and can be easily damaged interrupting the throughput of material.

A general object of this invention is to provide an improved crushing apparatus.

SUMMARY OF THE INVENTION

In accordance with the invention, an improved drive system for rotatable crushing means, e.g., toothed rollers or drums, of crushing apparatus comprises hydraulic motors mounted inside the crushing means.

Apparatus constructed in accordance with the invention may comprise a pair of contra-rotatable generally upstanding drums for crushing material fed therebetween and a hydraulic drive motor mounted inside each drum to rotatably drive the latter. The hydraulic motors may take the form of wheel-hub motors, as known per se. By locating the drive motors inside the crusher drums, a considerable reduction in the height of the apparatus results and the overall design can be simplified. Moreover, the motors are protected from the exterior.

Each motor may have a rotor, such as a housing, connected to the associated crusher drum and a stator mounted to some form of support. Conveniently, the drums may have internal radial flanges connected to the rotors. No external bearings for the drums are thus necessary. A hollow flat base frame, which accommodates a conveyor transporting material through the crushing gap between the drums, may accommodate hydraulic hoses or pipes leading to the motors conveniently through openings at the bottoms of the drums.

In accordance with a preferred feature of the invention, the drums are supported by pivotable rocker arms supported by the base housing. Means, such as hydraulic piston and cylinder units, can swing the rocker arms to adjust the crushing gap. Such a design also protects the apparatus by allowing the drums to move apart should a large piece of material be encountered. Conveniently, the stators of the rotors are supported by the rocker arms. The rocker arms can also be hollow so that the hydraulic hoses can be lead through the rocker arms into the drums and hence to the motors. Protective housings can cover off the drums, except for the crushing gap, and these housings can also be connected to the rocker arms.

The invention may be understood more readily and various other aspects and features of the invention may become apparent from consideration of the following description.

BRIEF DESCRIPTION OF DRAWING

An embodiment of the invention will now be described, by way of example only, with reference to the accompanying drawing, wherein.

DESCRIPTION OF PREFERRED EMBODIMENT

Figure 2:
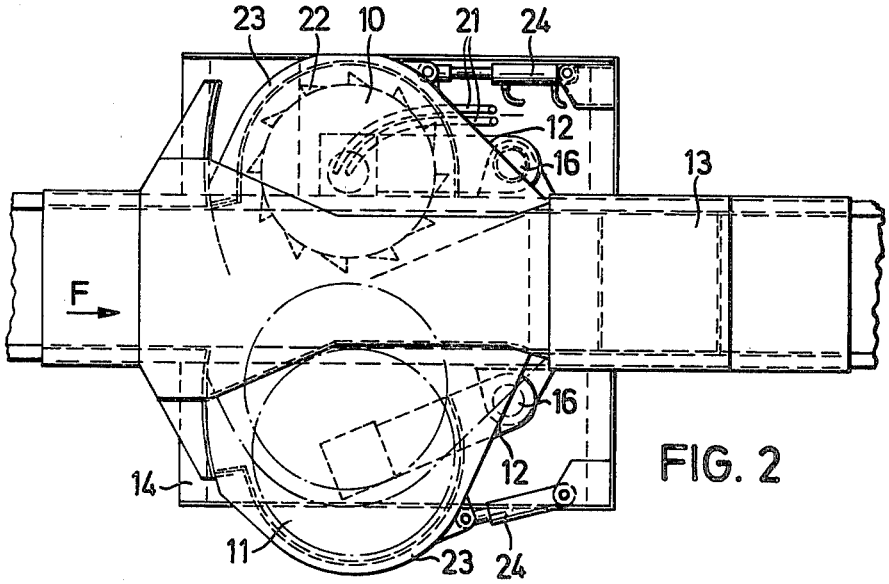
FIG. 2 is a plan view of the apparatus shown in FIG. 1.

As shown in the accompanying drawing, crushing apparatus made in accordance with the invention has a flat base frame 14 of hollow box-like construction, which is provided with a recessed portion 15 at its central region. This recessed portion 15 forms a trough for accommodating part of a scraper chain conveyor 13, which conveys mineral ore or the like through the apparatus in the direction of arrow F in FIG. 2. The apparatus employs crushing means in the form of two upstanding rotatable crusher drums or rollers 10,11 which are disposed above the bottom frame and rotate about vertical axes (as shown) or slightly inclined axes. As is known, the drums 10,11 rotate in opposite directions and are equipped with tools or bits 22, which break-up material fed between the drums 10,11 by the conveyor 13.

Figure 1:
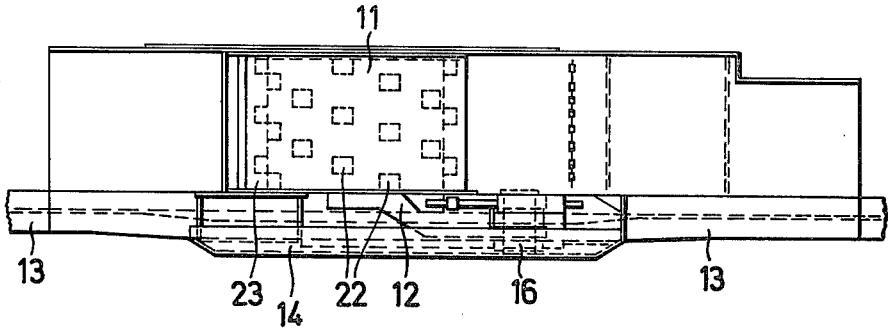
FIG. 1 is a schematic side elevation of apparatus made in accordance with the invention.
Figure 3:
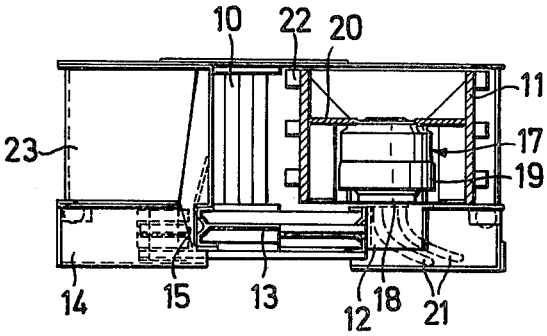
FIG. 3 is a part-sectional end view of the apparatus shown in FIGS. 1 and 2.

Each drum 10,11 is rotatably supported on a rocker arm 12, which is pivotably connected to the bottom frame 14 to swing about a vertical pivot joint 16. In order to swing the arms 12 about the axes 16, to permit the crushing gap between the drums 10,11 to be adjusted, hydraulic piston and cylinder units 23 are provided. The units 24 are effectively connected between the respective arms 12 and the base frame 14. The units 24 serve to protect the apparatus against overloading, since large pieces of material progressing through the crushing gap can move the arms 12 to draw the drums 10,11 apart and thereby open the crushing gap. Each rocker arm 12 has a hydraulic wheelhub motor 17 at its free end which drives the associated drum 10,11. As shown in FIG. 3, the drums 10,11 are hollow and surround the motors 17. Each motor 17 has a stationary inner stator 18 secured to the associated rocker arm 12 and a rotor in the form of an outer housing 19 surrounding the stator 18 and fixed to the associated drum 10,11. Each drum 10,11 has an internal radial flange 20 secured to the rotor housing 19 of the associated drive motor 17. The drums 10,11 can be easily fitted and withdrawn from above in respect of the motors 17. Each drum 10,11 has an opening at the bottom through which hydraulic hoses, conduits or pipes 21 for the motor 17 pass. The rocker arms 12 are also hollow and the pipes 21 are conducted through the arms 12 into the base frame 14 from whence they are led off to the exterior.

The drums 10,11 are covered by guard housings 23, supported on the rocker arms 12 and conveniently, the units 24 connect to the housing 23. These housings 23 are open towards one another to permit the entry and exit of material through the crushing gap between the drums 10,11.

The provision of the motors 17 inside the drums 10,11 leads to an especially simple compact construction. The overall height of the apparatus is considerably reduced in relation to prior art apparatus and the vulnerable parts of the apparatus are well protected against damage.

We claim:

1. Apparatus for crushing or breaking material, especially mineral ores; said apparatus comprising a pair of contra-rotatable generally upstanding drums for crushing material fed therebetween and a hydraulic drive motor mounted inside each drum to rotatably drive the latter.

2. Apparatus according to claim 1, wherein each drive motor has a rotor connected to an internal radial flange inside the associated drum.

3. Apparatus according to claim 1, wherein the drums have openings at the bottom to permit the passage of hydraulic fluid conveying pipes leading to the motors.

4. Apparatus according to claim 1, wherein the drums are supported on pivotable rocker arms.

5. Apparatus according to claim 4, wherein each motor has a stator fixed to an associated one of the rocker arms and a rotor fixed to the associated drum.

6. An apparatus according to claim 4, wherein the rocker arms are hollow.

7. An apparatus according to claim 4, wherein hydraulic piston and cylinder units are provided for swinging the rocker arms to adjust the gap between the drums.

8. An apparatus according to claim 1, wherein guard housings extend around the drums and a lower base frame supports the drums thereabove and accommodates a scraper-chain conveyor which transports material through the apparatus.

* * * * *